US008959727B2

(12) United States Patent
Keyaki et al.

(10) Patent No.: US 8,959,727 B2
(45) Date of Patent: Feb. 24, 2015

(54) SLIDE FASTENER WITH SEPARABLE BOTTOM END STOP

(75) Inventors: Keiichi Keyaki, Toyama (JP); Yuichi Iwase, Toyama (JP)

(73) Assignee: YKK Corporation (JP)

( * ) Notice: Subject to any disclaimer, the term of this patent is extended or adjusted under 35 U.S.C. 154(b) by 277 days.

(21) Appl. No.: 13/124,691

(22) PCT Filed: Dec. 26, 2008

(86) PCT No.: PCT/JP2008/073712

§ 371 (c)(1),
(2), (4) Date: Apr. 18, 2011

(87) PCT Pub. No.: WO2010/073362

PCT Pub. Date: Jul. 1, 2010

(65) Prior Publication Data

US 2011/0197402 A1 Aug. 18, 2011

(51) Int. Cl.
*A44B 19/30* (2006.01)

(52) U.S. Cl.
USPC ..... 24/421; 24/386; 24/424

(58) Field of Classification Search
CPC .... A44B 19/38; A44B 19/388; A44B 19/382; A44B 19/30; A44B 19/306; A44B 19/308
USPC ..... 24/386, 436, 420, 421, 424, 418, 423, 24/391, 435
See application file for complete search history.

(56) References Cited

U.S. PATENT DOCUMENTS 2,303,750 A * 12/1942 Marinsky ..... 24/418
5,031,286 A * 7/1991 Kedzierski ..... 24/421
5,625,928 A 5/1997 Terada et al.
5,898,979 A * 5/1999 Hamada ..... 24/418
6,009,602 A 1/2000 Terada
2002/0050031 A1 5/2002 Takasawa et al.

(Continued)

FOREIGN PATENT DOCUMENTS

JP 7-313215 A 12/1995
JP 11-176615 A 7/1999

(Continued)

OTHER PUBLICATIONS

International Search Report and Written Opinion, PCT International Patent Application No. PCT/JP2008/073712, mailed Mar. 10, 2009.

*Primary Examiner* — Robert J Sandy
*Assistant Examiner* — Michael Lee
(74) *Attorney, Agent, or Firm* — Kilpatrick Townsend & Stockton LLP

(57) ABSTRACT

Provided is a slide fastener with a separable bottom end stop having both an automatic stopper and the separable bottom end stop, of which structural components can be used for both left- and right-insertions. In the slide fastener, a stop pawl for the automatic stopper protruding into an element guide passage via a pawl hole is configured to be movable in the lateral direction to an insert pin side and a box pin side. Accordingly, when the insert pin is inserted into the element guide passage through a shoulder opening of a top slider to re-couple separated fastener stringers, the stop pawl can be retreated by the insert pin as being pushed. Accordingly, the insert pin can be smoothly inserted deeply to the top slider with small resistance force. Further, structural components of the slide fastener with the separable bottom end stop can be used for both left- and right-insertions.

4 Claims, 9 Drawing Sheets

(56) References Cited

U.S. PATENT DOCUMENTS

| | | | | |
|---|---|---|---|---|
| 2006/0282998 | A1 | 12/2006 | Kusayama et al. | |
| 2008/0092347 | A1* | 4/2008 | Ogura | 24/433 |
| 2009/0049659 | A1* | 2/2009 | Takani et al. | 24/426 |
| 2009/0094805 | A1* | 4/2009 | Keyaki et al. | 24/433 |
| 2011/0191989 | A1* | 8/2011 | Fujii | 24/415 |
| 2011/0232047 | A1* | 9/2011 | Ogura | 24/386 |
| 2012/0000040 | A1* | 1/2012 | Ogura | 24/391 |
| 2012/0167354 | A1* | 7/2012 | Keyaki et al. | 24/386 |
| 2012/0260468 | A1* | 10/2012 | Nozaki et al. | 24/386 |

FOREIGN PATENT DOCUMENTS

| | | | |
|---|---|---|---|
| JP | 3621040 | B2 | 2/2005 |
| JP | 2006-346364 | A | 12/2006 |

* cited by examiner

SLIDE FASTENER WITH SEPARABLE BOTTOM END STOP

This application is a national stage application of PCT/JP2008/073712, which is incorporated herein by reference.

TECHNICAL FIELD

The invention relates to a slide fastener with a separable bottom end stop equipped with a box pin and an insert pin which are disposed respectively to one side edge of right and left fastener stringers and a slider with an automatic stopper.

BACKGROUND ART

In the related art, a slide fastener having a slider equipped with an automatic stopper or a semi-automatic stopper has been known for preventing a problem of natural opening of the slide fastener due to natural lowering of the slider.

Further, in the related art, a slide fastener with a separable bottom end stop has been known, the slide fastener being configured such that right and left fastener stringers can be separated after a slider of the slide fastener is slid to the lowermost position and the right and left fastener stringers are opened.

An invention of a slide fastener with a separable bottom end stop having both the above slider with an automatic stopper and the separable bottom end stop is disclosed in Japanese Patent Application Publication No. 3621040 (Patent document 1). In the slide fastener described in Patent document 1, a stop pawl of a pawl member is configured to protrude from and retreat to a pawl hole formed in a front blade with respect to an element guide passage formed between the front blade and a back blade of the slider.

The stop pawl is resiliently urged in the direction of being protruded into the element guide passage due to an urging member. Accordingly, when an insert pin is inserted into the slider from a state where the right and left fastener stringers are separated, the stop pawl of the pawl member protruded to the element guide passage is contacted with the insert pin. It is described that the insert pin is smoothly inserted to the slider by utilizing the separable bottom end stop described in the invention of Patent document 1, since the insert pin according to the invention of Patent document 1 includes an inclined face for pushing-up to gradually push up the stop pawl.

Further, Japanese Patent Application Laid-Open No. 2006-346364 (Patent document 2) discloses a slide fastener with a separable bottom end stop having a chamfered portion formed at a corner portion of an insert pin on a coupling end edge side and a slider front blade side to prevent interference with a stop pawl for an automatic stopper protruding into an element guide passage from a pawl hole opened in the slider front blade.

Patent document 1: Japanese Patent Application Publication No. 3621040

Patent document 2: Japanese Patent Application Laid-Open No. 2006-346364

DISCLOSURE OF THE INVENTION

Problems to be Solved by the Invention

In the slide fastener described in Patent document 1, when the insert pin is inserted into the slider from a state where the right and left fastener stringers are separated, the stop pawl is contacted with the lower end part of the insert pin at some midpoint. The stop pawl is urged in the direction of being protruded into the element guide passage. When the insert pin is further inserted against the urging force, the stop pawl is raised along the inclined face for pushing-up formed at the insert pin. Since the stop pawl is urged with predetermined force to prevent natural lowering of the slider, a user feels resistance force to raise the stop pawl along the inclined face at that time.

Further, in the slide fastener described in Patent document 2, the interference with the stop pawl protruding from the front blade of the slider can be prevented by forming a chamfered portion at a corner portion of the insert pin on the coupling end edge side and the slider front blade side. Here, when the inset pin is to be commonly used for a left-insertion separable bottom end stop which is widely and generally spread in Japan and a right-insertion separable bottom end stop which is partially spread in foreign countries, the chamfered portion is required to be formed at both corners at both the front blade side and the back blade side of the slider. Hence, there may be a case that the shape of the insert pin becomes sharpened at the coupling end edge side or that the thickness of a part to bite a core thread becomes thin.

To improve the above issues in the related art, the invention provides a slide fastener with a separable bottom end stop including both an automatic stopper and the separable bottom end stop constituted with components which can be used for both left- and right-insertions.

Solutions to the Problems

In order to achieve the above object, the invention provides a slide fastener with a separable bottom end stop, including: a box pin continuously arranged at a lower end of a first element row which is disposed at one side edge of a first fastener stringer; an insert pin continuously arranged at a lower end of a second element row which is disposed at one side edge of a second fastener stringer configured to be capable of being separated from the first fastener stringer; and a top slider for upper opening including an automatic stopper which is constituted with a pawl member having a stop pawl formed to be capable of protruding from and retreating to a pawl hole opened in a front blade with respect to an element guide passage formed between the front blade to cover a front side and a back blade to cover a back side of the first element row and the second element row, an urging member to resiliently urge the stop pawl in a direction of protruding into the element guide passage, and a tab capable of raising the stop pawl in a direction of being withdrawn from the element guide passage by disposing a tab pivot portion between the front blade and the pawl member and upwardly moving the tab pivot portion, being characterized in that the stop pawl protruding into the element guide passage is configured to be movable in a lateral direction toward the insert pin side and the box pin side, and the pawl hole has a wide opening to enable a movement of the stop pawl.

In addition, it is preferable that a retreat contact portion to gradually retreat the stop pawl to the box pin side as being contacted with the stop pawl which protrudes into the element guide passage when the inset pin is inserted into the top slider from a separated state be disposed at a corner portion of an insertion end of the insertion pin on the box pin side.

In addition, it is preferable that a pawl retreat portion to accommodate the retreated pawl member be formed at the box pin on the front blade side.

In addition, it is preferable that rear openings of the top slider for upper opening and a bottom slider for reverse opening having the automatic stopper be disposed so as to face each other, and that a drop prevention portion to prevent dropping from the bottom slider be formed at the box pin.

Effects of the Invention

In the slide fastener with a separable bottom end stop having both the slider with the automatic stopper and the separable bottom end stop according to the invention, the stop pawl protruding into the element guide passage is constituted to be movable toward the box pin side and the insert pin side. Therefore, when the insert pin is inserted into the slider from a state where the right and left fastener stringers are separated, the stop pawl pushed by the insert pin is retreated toward the box pin side. Since the force necessary to retreat the stop pawl is far smaller than the force required to raise the stop pawl, the insert pin can be inserted into the slider with smaller operational force.

Further, according to the invention, the front and back of the insert pin can be easily formed to be symmetric, so that the insert pin can be easily utilized commonly for a separable bottom end stop for a left-insertion and a separable bottom end stop for a right-insertion.

Further, according to another invention, since the retreat contact portion is formed at a corner portion of the insertion end of the insert pin on the box pin side, the stop pawl can be gradually retreated to the box pin side when the insert pin is inserted into the top slider from a separated state. Accordingly, the insert pin can be inserted into the slider with smaller operational force.

Further, according to another invention, since the pawl retreat portion is formed at the box pin on the front blade side, it is possible to be stored on the box pin side without increasing the resistance force against the pawl member pushed and retreated by the insert pin.

Furthermore, another invention provides a slide fastener with a separable bottom end stop capable of performing reverse opening by arranging the rear openings of the top slider for upper opening and the bottom slider for reverse opening so as to face each other. In this case as well, the insert pin, the box pin, the top slider and the bottom slider can be commonly used for left- and right-insertions.

DESCRIPTION OF REFERENCE SIGNS

Figure 1:
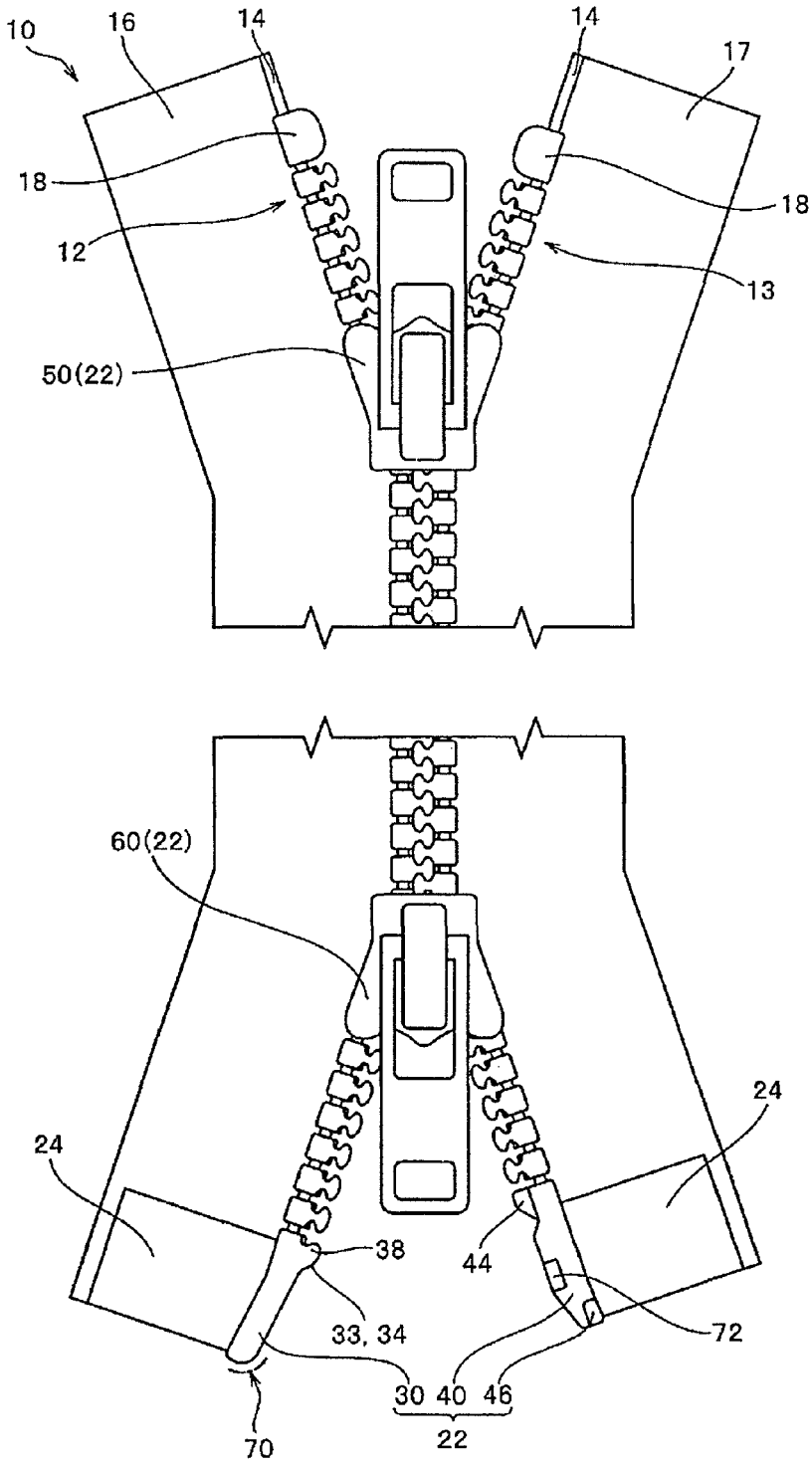
FIG. 1 is an outline view of an entire reverse opening slide fastener.

10, 10A Slide fastener with separable bottom end stop
12 Second element row
13 First element row
14 Core thread
16 Second fastener stringer
17 First fastener stringer
18 Top stopper
22 Separable bottom end stop
24 Reinforcement film
30, 30A Insert pin
33 Recess
34 Second engaging portion
38 Coupling protrusion
40, 40A Box pin
40B Box body
44 First engaging portion
46 Drop prevention portion
50, 50A Top slider
50B Drop prevention stepped portion
50D Connecting post
50F Flange portion
51 Element guide passage
52 Front blade
53 Back blade
54 Pawl hole
55 Pawl member
55A Stop pawl
55B Pivot portion
56 Attaching post
56A Receiving hole
56B Guide restriction portion
56C Fit convex portion
57 Urging member
57C Fit concave portion
58 Cover
59 Tab
59A Tab pivot portion
60 Bottom slider
70 Retreat guide portion
72 Pawl retreat portion

BEST MODE FOR CARRYING OUT THE INVENTION

In the following, exemplary embodiments of a reverse opening slide fastener according to the invention will be specifically described with reference to the drawings.

First Embodiment

FIG. 1 is an outline view of an entire slide fastener 10 with a separable bottom end stop capable of performing reverse opening as a front view illustrating a state where upper and lower end parts are opened as a top slider 50 being slightly lowered downward from a contact position with a top stopper 18 and as a bottom slider 60 being slightly lifted upward from an insertion position of a box pin 40 and an insert pin 30. Here, a separable bottom end stop 22 is constituted with the box pin 40, the insert pin 30, the top slider 50 and the bottom slider 60.

As illustrated in FIG. 1, the slide fastener 10 with the separable bottom end stop capable of performing reverse opening is an opening and closing device enabling to perform opening and closing between a left front body and a right front body of a long coat and the like. The slide fastener 10 with the separable bottom end stop is provided with a second fastener stringer 16, a first fastener stringer 17, right and left core threads 14 arranged respectively along opposing side edge parts of the second fastener stinger 16 and the first fastener stringer 17, and a second element row 12 and a first element row 13 respectively having a number of elements at predetermined intervals so as to nip each core thread 14.

Further, the slide fastener 10 with the separable bottom end stop includes a top slider 50 capable of performing upper opening as being inserted with the second element row 12 and the first element row 13 and a bottom slider 60 capable of performing reverse opening. A rear opening of the top slider 50 and a rear opening of the bottom slider 60 are arranged so as to face each other. The top stopper 18 is secured to each upper part of the respective core thread 14 of the second element row 12 and the first element row 13 to prevent dropping of the top slider 50 from the second element row 12 and the first element row 13.

As illustrated in FIG. 1, a reinforcement film 24 formed of a resin-made film and the like is stuck to both faces at the lower end of the first fastener stringer 17. Then, the box pin 40 is secured so as to nip both the reinforcement film 24 and the core thread 14. Further, similarly, the reinforcement film 24 is stuck to both faces at the lower end of the second fastener stringer 16, and then, the insert pin 30 is secured so as to nip both the reinforcement film 24 and the core thread 14.

A drop prevention portion 46 shaped convex is formed at the lower end of the box pin 40. The bottom slider 60 is prevented from dropping downward by being contacted with a drop prevention stepped portion 50B which is formed at a shoulder opening portion in an element guide passage 51 of a front blade 52 or a back blade 53 of the bottom slider 60 when the bottom slider 60 is lowered to the lowermost position. Here, the shape of the drop prevention portion is not limited to the shape illustrated in FIG. 1. For example, it is also possible to prevent downward dropping of the bottom slider by forming a hook-shaped drop prevention portion at the lower end of the box pin to be directly contacted with a flange portion at the shoulder opening portion of the bottom slider when the bottom slider is lowered to the lowermost position.

A first engaging portion 44 which is triangularly plate-shaped protrudes from an opposing side face of the box pin 40 opposed to the insert pin 30 on the first element row 13 side. The first engaging portion 44 is to be engaged with a later-described second engaging portion 34 of the insert pin 30.

A second engaging portion 34 of which engaging face faces downward protrudes from an opposing side face of the insert pin 30 opposed to the box pin 40 as being reinforced by both side walls. The second engaging portion 34 performs positioning in the vertical direction of the insert pin 30 with respect to the box pin 40 by engaging with the first engaging portion 44 of the box pin 40 when the insert pin 30 is inserted to the bottom slider 60 which is moved to the lowermost position. A recess 33 which is surrounded by both the side walls is formed at the lower side of the second engaging portion 34. The first engaging portion 44 of the box pin 40 enters to the recess 33. A round-chamfered retreat guide portion 70 which gradually retreats a stop pawl 55A toward the box pin 40 side by being contacted with the stop pawl 55A protruding into the element guide passage 51 when the insert pin 30 is inserted to the top slider 50 and the bottom slider 60 from an separated state is formed at a corner portion of the insertion end of the insert pin 30 on the box pin 40 side.

Further, a concave-shaped pawl retreat portion 72 to accommodate the stop pawl 55A (see FIGS. 2 to 4) which is to be retreated corresponding to insertion of the insert pin 30 is formed at an approximate center part of the box pin 40 on the opposing side face opposing to the insert pin 30 and on the front blade 52 side of the bottom slider 60.

Figure 2:
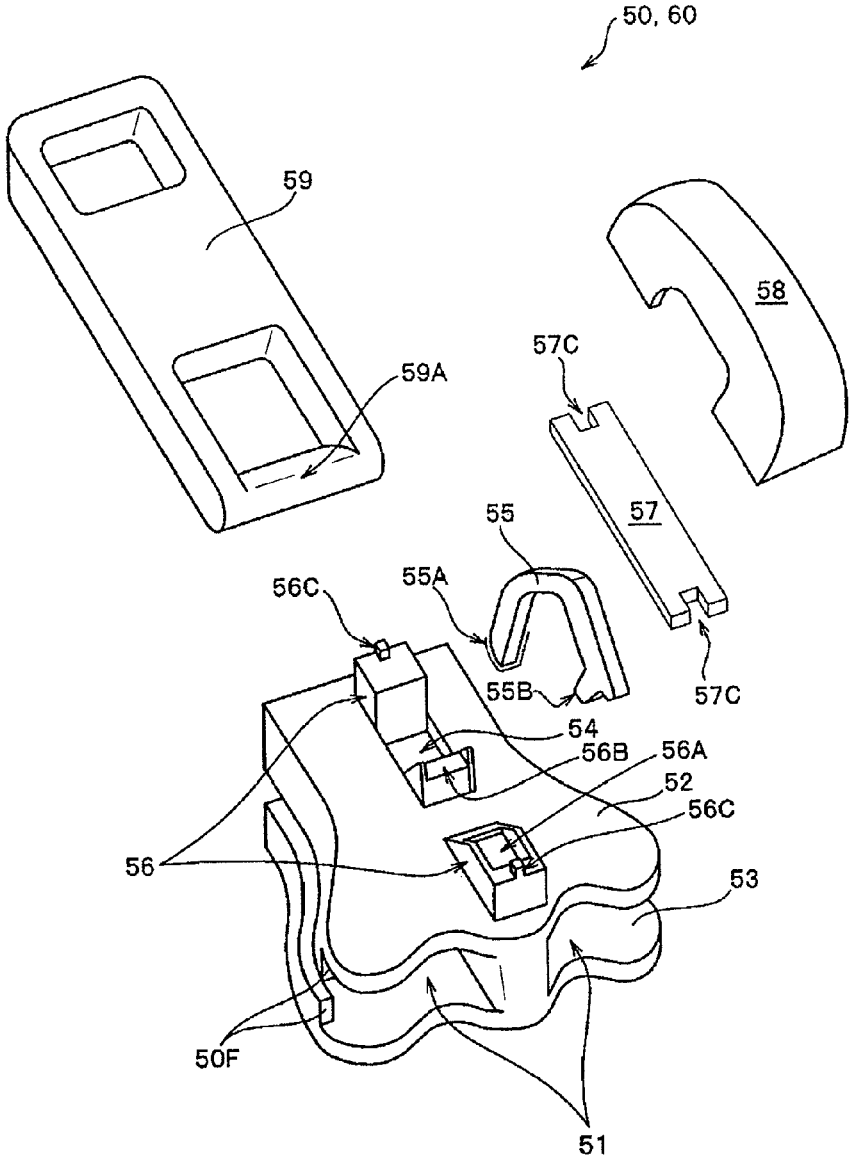
FIG. 2 is an exploded perspective view of a slider.
Figure 3:
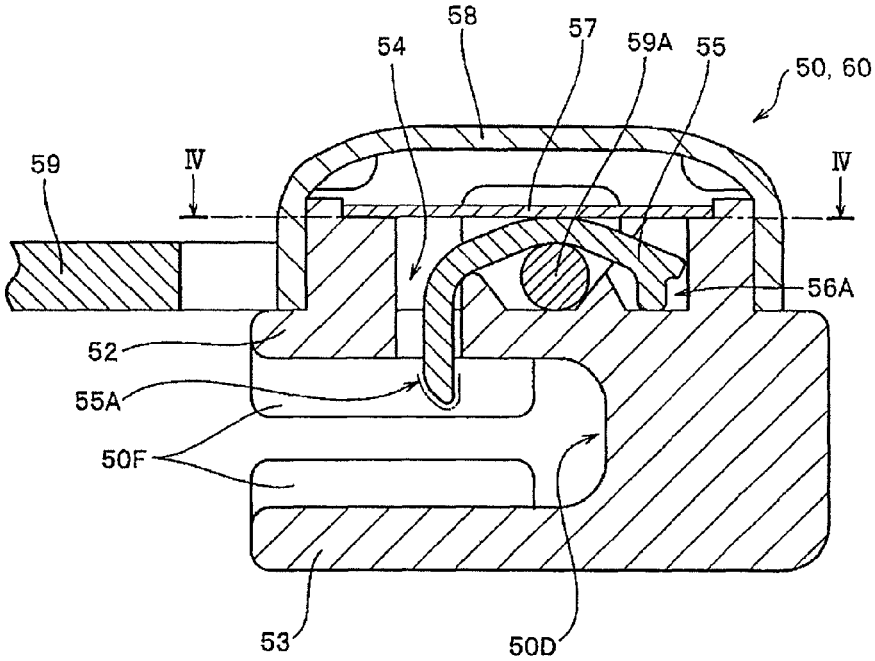
FIG. 3 is a sectional side view of the slider.
Figure 4:
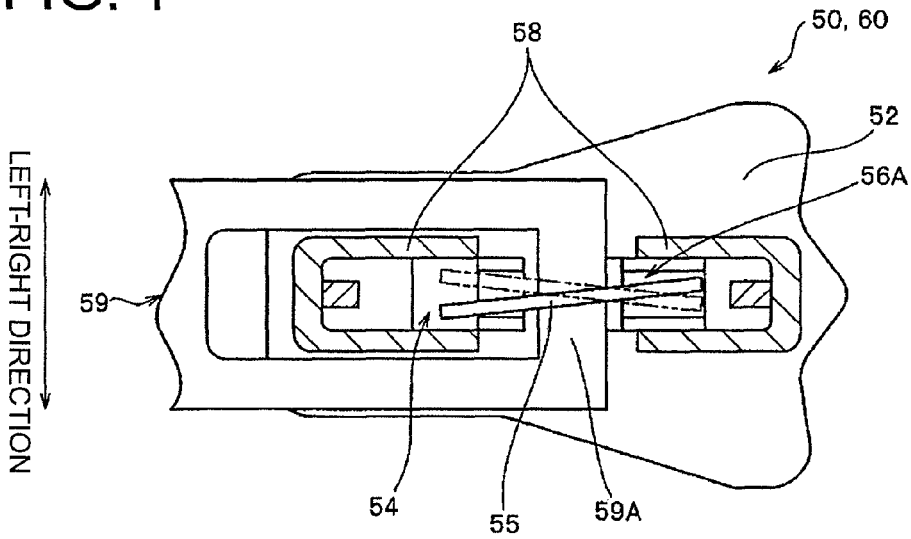
FIG. 4 is a sectional plane view illustrating a movement state of a pawl member of the slider seen from IV-IV in FIG. 3.

Next, the configuration of the top slider 50 and the bottom slider 60 will be described with reference to FIGS. 2 to 4. FIG. 2 is an exploded perspective view of the top slider 50 and the bottom slider 60. FIG. 3 is a sectional side view after assembling of the top slider 50 and the bottom slider 60. Further, FIG. 4 is a sectional plane view of the top slider 50 and the bottom slider 60 and illustrates a movement state of the pawl member 55. Here, FIG. 4 is a sectional view seen from IV-IV in FIG. 3.

As illustrated in FIG. 3, the front blade 52 and the back blade 53 of the top slider 50 and the bottom slider 60 are respectively connected with a connecting post 50D. The top slider 50 and the bottom slider 60 are respectively constituted with a slider main body in which a shoulder opening of the element guide passage 51 is opened at both sides of the connecting post 50D, a tab 59 to vertically move the slider main body, a pawl member 55 having the stop pawl 55A formed at one end to be inserted between adjacent elements of the first and second element rows 12, 13 to prevent a problem of natural lowering movement of the top slider 50 and the bottom slider 60, a plate-spring-shaped urging member 57 to resiliently urge the stop pawl 55A in the direction to be protruded into the element guide passage 51 by pressing the pawl member 55 toward the element guide passage 51 side, and a cover 58 to cover the pawl member 55 and the urging member 57 from the front side.

Two attaching posts 56 to fix the cover 58 as being covered are arranged on the front side of the front blade 52 of the slider main body. A receiving hole 56A into which a pivot portion 55B of the pawl member 55 is inserted is formed at the center part of the attaching post 56 of the shoulder opening side. A pawl hole 54 communicated to the element guide passage 51 as penetrating the front blade 52 is formed between the attaching post 56 of the shoulder opening side and the attaching post 56 of the back opening side. The pawl hole 54 is an opening into which the stop pawl 55A of the pawl member 55 is inserted to the inside of the element guide passage 51. The pawl hole 54 is the opening to enable operation that the stop pawl 55A is inserted into and withdrawn from the element guide passage 51 and movement in the lateral direction.

A concave-shaped guide restriction portion 56B to restrict the maximum protrusion quantity of the stop pawl 55A of the pawl member 55 when being protruded to the element guide passage 51 and to restrict lateral movement quantity of the stop pawl 55A is formed between the pawl hole 54 and the receiving hole 56A on the front side of the front blade 52. A valley portion surrounded by inclined faces through which a tab pivot portion 59A of the tab 59 passes is formed between the guide restriction portion 56B and the attaching post 56 on the shoulder opening side.

Here, a flange portion 50F to engage the second element row 12 and the first element row 13 corresponding to the slider movement is formed respectively at both side edge parts of the front blade 52 and the back blade 53. A gap through which each fastener tape of the second fastener stringer 16 and the first fastener stringer 17 passes is formed at a part at which the flange portions 50F of the front blade 52 and the back blade 53 are opposed to each other.

When assembling the top slider 50 and the bottom slider 60, the tab pivot portion 59A of the tab 59 is firstly placed between the guide restriction portion 56B and the attaching post 56 on the shoulder opening side. Next, the pivot portion 55B of the pawl member 55 is inserted into the receiving hole 56A opening at the center part of the attaching post 56 on the shoulder opening side, and then, the main body center of the pawl member 55 is placed on the concave portion of the guide restriction portion 56B. Then, the stop pawl 55A of the pawl member 55 is inserted into the inside of the pawl hole 54.

Next, the urging member 57 is placed so as to press the upper face side of the pawl member 55 from the front face side of the front blade 52, and then, fit concave portions 57C formed at both ends of the urging member 57 and fit convex portions 56C protruding at the top ends of the two attaching posts 56 are respectively fitted. Next, the cover 58 to cover the pawl member 55 and the urging member 57 for appearance is placed and caulked on the attaching posts 56. Functions of an automatic stopper of the top slider 50 and the bottom slider 60 assembled as described above will be described with reference to FIG. 3.

FIG. 3 is a sectional side view of the top slider 50 and the bottom slider 60 sectioned on the coupling axial line. Here, the same numeral is given to the same member as that in FIG. 2 and the description will not be repeated.

As illustrated in FIG. 3, when the tab 59 is not operated by a user, the stop pawl 55A is protruded into the element guide passage 51 as the urging member 57 resiliently urges the upper face side of the pawl member 55 in the direction to press toward the element guide passage 51 side. Although the first element row 13 and the second element row 12 are not illustrated, the stop pawl 55A protruded to the element guide passage 51 enters between adjacent elements of the first element row 13 and the second element row 12 in the state of FIG. 3. Accordingly, resistance force is generated against the vertical direction of the slide fastener, so that free movement of the top slider 50 and the bottom slider 60 is restricted.

When the user applies force upward or downward as grasping the tab 59 to move the top slider 50 or the bottom slider 60, the tab pivot portion 59A presses up the lower face side of the pawl member 55 as overcoming the urging force of the urging member 57 with the force. Then, the pawl member 55 is swung to the front side about pivot portion 55B and is moved in the direction that the stop pawl 55A is withdrawn from the element guide passage 51. Accordingly, the press force pressing the first element row 13 or the second element row 12 is weakened, so that the top slider 50 or the bottom slider 60 are easily moved in the vertical direction of the slide fastener.

When the movement of the top slider 50 or the bottom slider 60 is completed, the user releases the grasped tab 59. Since the urging member 57 presses the upper face side of the pawl member 55, the stop pawl 55A is moved in the direction to protrude to the element guide passage 51 and enters between adjacent elements of the first element row 13 and the second element row 12 once again. Accordingly, even though the top slider 50 or the bottom slider 60 is let to move in the vertical direction of the slide fastener, the resistance force against the vertical direction of the slide fastener is increased due to engagement between the stop pawl 55A and the elements. In this manner, the free movement of the top slider 50 or the bottom slider 60 is restricted.

Here, in the embodiment of FIG. 3, the stop pawl 55A is protruded into the element guide passage 51 by urging the upper face side of the pawl member 55 by utilizing the plate-spring-shaped urging member 57. However, besides the above embodiment, it is also possible to configure to protrude a stop pawl into the element guide passage 51 by utilizing an urging member such as a compression spring and a tension spring. Further, the pawl member itself can be configured to generate urging force to protrude the stop pawl into the element guide passage 51 by forming a pawl member of a resilient material.

Next, a situation of lateral movement of the stop pawl 55A protruded into the element guide passage 51 toward the insert pin 30 and the box pin 40 will be described with reference to FIG. 4. FIG. 4 is a sectional plane view illustrating a sectioned state of the top slider 50 and the bottom slider 60 seen from IV-IV in FIG. 3. Here, the same numeral is given to the same member as that in FIGS. 2 and 3 and the description will not be repeated.

As illustrated in FIG. 4, the pawl member 55 is configured to be swingable about the pivot portion 55B (see FIG. 2) which is inserted into the receiving hole 56A. Corresponding to the swing of the pawl member 55, the stop pawl 55A (see FIG. 2 or FIG. 3) of the pawl member 55 is moved in the lateral direction (Left-Right direction in FIG. 4) within the pawl hole 54. In the embodiment of FIG. 4, the pawl member 55 is swung about the pivot portion 55B which is inserted into the receiving hole 56A. However, the invention is not limited to the above form of swinging. The invention can be actualized even when the pawl member 55 is laterally moved in parallel.

Further, in the embodiment of FIG. 4, since the stop pawl 55A is configured to perform side movement as being bilaterally symmetric against the coupling axial line of the slide fastener 10 with the separable bottom end stop, the top slider 50 and the bottom slider 60 can be used for both left- and right-insertions. However, the invention is not limited to the bilaterally symmetric movement of the stop pawl 55A.

Figure 5:
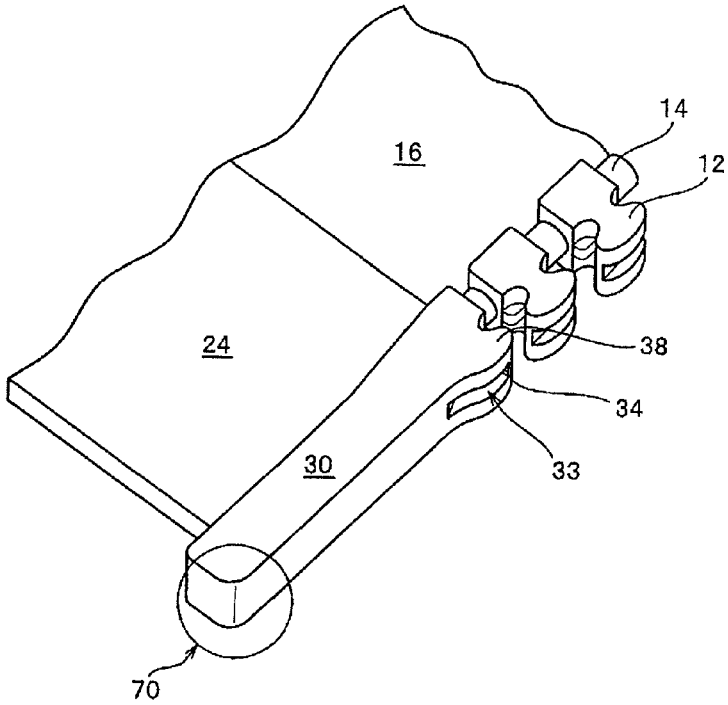
FIG. 5 is a partial perspective view of a lower end of a second fastener stringer to which an insert pin is continuously arranged.
Figure 6:
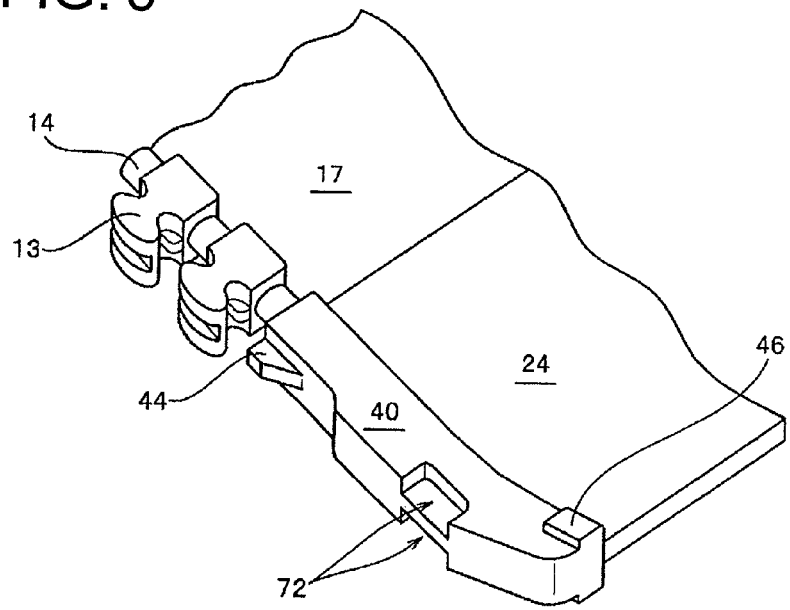
FIG. 6 is a partial perspective view of a lower end of a first fastener stringer to which a box pin is continuously arranged.

Next, the configuration of the insert pin 30 and the box pin 40 placed at the lower end of fastener stringers will be described with reference to FIGS. 5 and 6. FIG. 5 is a partial perspective view of a lower end of a second fastener stringer 16 having the insert pin 30 secured. FIG. 6 is a partial perspective view of a lower end of a first fastener stringer 17 having the box pin 40 secured. Here, the same numeral is given to the same member as that in FIG. 1 and the description will not be repeated.

As illustrated in FIG. 5, the core thread 14 is formed at a side edge part of the second fastener stringer 16 on the coupling end edge side. The second element row 12 is formed to serially arrange a number of elements at the predetermined intervals as nipping the core thread 14.

The reinforcement film 24 formed of a resin-made film and the like is stuck respectively to both faces at the lower end of the second fastener stringer 16. The insert pin 30 is arranged continuously to the lower end of the second element row 12 as nipping both the reinforcement film 24 and the core thread 14.

A coupling protrusion 38 to be coupled with an element placed at the lowermost position of the first element row 13 is formed at the upper end part of the insert pin 30 on the coupling end edge side. The second engaging portion 34 to prevent lowering of the insert pin 30 passing through the bottom slider 60 as positioning the insert pin 30 in the vertical direction with respect to the box pin 40 by being engaged with the first engaging portion 44 of the box pin 40 when the insert pin 30 is inserted into the bottom slider 60 which is moved to the lowermost position is formed at the center of an element head of the coupling protrusion 38 of the insert pin 30. The recess 33 to which the first engaging portion 44 of the box pin 40 is inserted is surrounded by the second engaging portion 34 and the side walls for reinforcement.

Further, the round-chamfered retreat guide portion 70 which gradually retreats the stop pawl 55A toward the box pin 40 side by being contacted with the stop pawl 55A protruding into the element guide passage 51 when the insert pin 30 is inserted into the top slider 50 and the bottom slider 60 from an separated state is formed at a corner portion of the insertion end of the insert pin 30 on the box pin 40 side. It is sufficient to form the round-chamfered shape only on the front blade 52 side to which the stop pawl 55A is protruded. However, since the embodiment of FIG. 5 is configured to be adoptable for both the left- and right-insertions, the round-chamfered shape is formed symmetrically at both the front blade 52 and the back blade 53. Here, the shape of the retreat guide portion 70 is not limited to the curved round-chamfered shape. It is also possible to adopt a straight corner-chamfered shape.

Further, as illustrated in FIG. 6, the core thread 14 is formed at a side edge part of the first fastener stringer 17 on the coupling end edge side. The first element row 13 is formed to serially arrange a number of elements at the predetermined intervals as nipping the core thread 14.

The reinforcement film 24 formed of a resin-made film and the like is stuck respectively to both faces at the lower end of the first fastener stringer 17. The box pin 40 is arranged continuously to the lower end of the first element row 13 so as to nip both the reinforcement film 24 and the core thread 14.

The plate-shaped first engaging portion 44 which is to be engaged with the second engaging portion 34 of the insert pin 30 is protruded from the upper end part of the box pin 40 on the coupling end edge side. Further, the concave-shaped pawl retreat portion 72 to accommodate the stop pawl 55A which is retreated is formed at the approximate center of the opposing side face of the box pin 40 opposing to the insert pin 30. Here, it is sufficient to form the pawl retreat portion 72 only at the front blade 52 side to which the stop pawl 55A is protruded. However, since the embodiment of FIG. 6 is configured to be adoptable for both the left- and right-insertions, the pawl retreat portion 72 is formed respectively at both the front blade 52 and the back blade 53 in a symmetric manner.

The convex-shaped drop prevention portion 46 is formed respectively at the faces of the lower end of the box pin 40 on the front blade 52 side and the back blade 53 side. The drop prevention portion 46 prevents the bottom slider 60 from dropping downward by being contacted with the drop prevention stepped portion 50B which is formed at the shoulder opening portion in the element guide passage 51 of the front blade 52 or the back blade 53 of the bottom slider 60 when the bottom slider 60 is lowered to the lowermost position. It is also sufficient to form the drop prevention portion 46 only either at the front blade 52 side or the back blade 53 side. However, in order to make the box pin adoptable for both the left- and right-insertions, the drop prevention portion 46 is formed respectively at both the front blade 52 side and the back blade 53 side in a symmetric manner.

Next, the state where the top slider 50 and the bottom slider 60 are lowered to the lowermost position from the state illustrated in FIG. 1 will be described with reference to FIG. 7.

Figure 7:
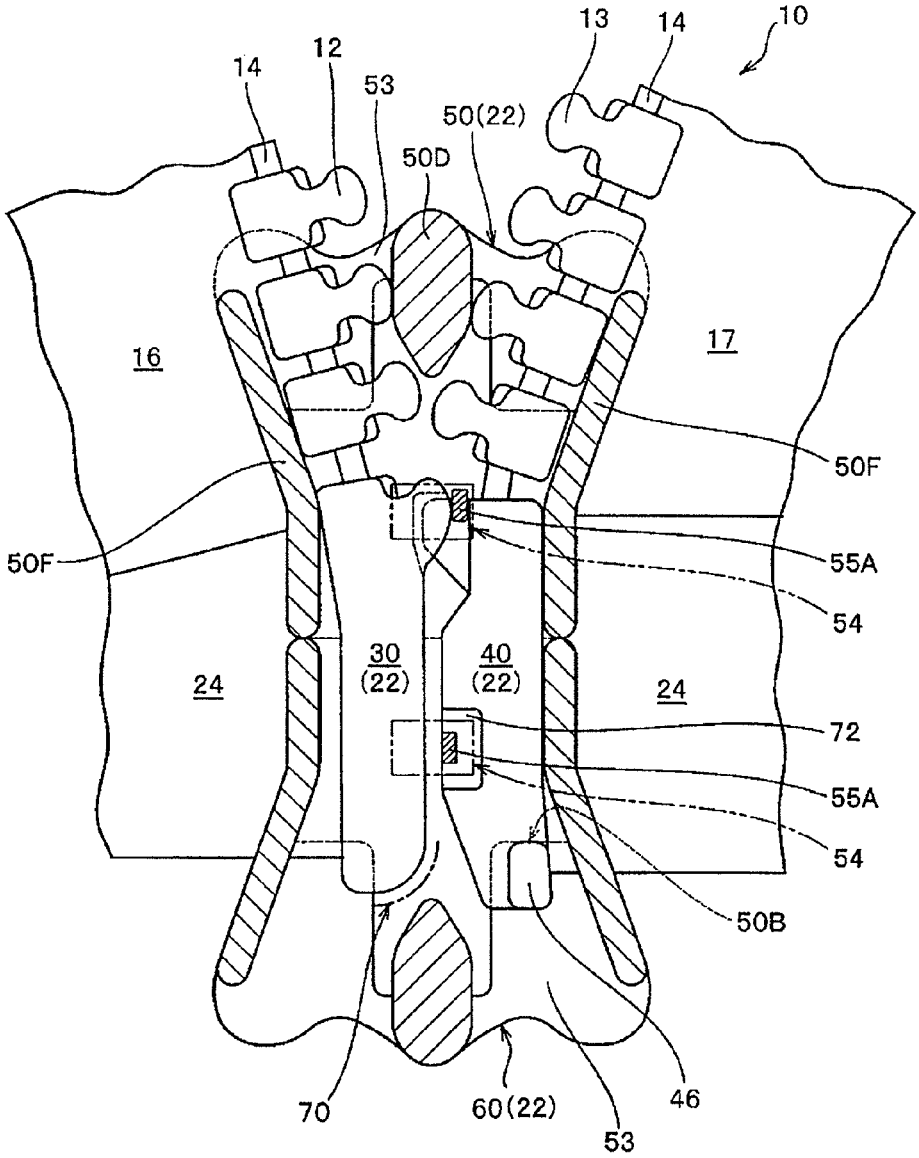
FIG. 7 is a sectional plane view of the reverse opening slide fastener when a top slider is lowered to the lowermost position which is contacted with a bottom slider.

FIG. 7 is a sectional plane view sectioned right below the front blade 52 illustrating the state where the top slider 50 and the bottom slider 60 of the slide fastener 10 with the separable bottom end stop are lowered to the lowermost position. Here, the same numeral is given to the same member as that in FIG. 1 and the description will not be repeated.

The element guide passage 51 through which the second element row 12 and the first element row 13 vertically passes is formed within the top slider 50 and the bottom slider 60. The element guide passage 51 includes a shoulder opening formed at the front end side and a rear opening formed at the rear end side of the top slider 50 and the bottom slider 60. The separated right and left elements are introduced to or ejected from the element guide passage through the shoulder opening and the coupled right and left elements are introduced to or ejected from the element guide passage through the rear opening.

When the bottom slider 60 is lowered, the laterally arranged second element row 12 and first element row 13 which are in a separated state are ejected from the rear opening of the bottom slider 60 in a coupled state. When the bottom slider 60 is further lowered as closing to the lowermost position, the box pin 40 and the insert pin 30 enter to the bottom slider 60 though the shoulder opening. Then, the bottom slider 60 stops as the drop prevention portion 46 formed at the lower end of the box pin 40 is contacted with the drop prevention stepped portion 50B formed respectively at the inner face of the front blade 52 and the back blade 53 in the element guide passage 51 at a position slightly inside from the shoulder opening of the bottom slider 60. The position is the lowermost position of the bottom slider 60.

In the state of FIG. 7, since both the top slider 50 and the bottom slider 60 are lowered to the lowermost position, the second fastener stringer 16 and the first fastener stringer 17 can be separated as pulling out the insert pin 30 from the top slider 50 and the bottom slider 60 by grasping the right and left reinforcement films 24 respectively with bilateral fingers in the above state and lifting the second fastener stringer 16 on the insert pin 30 side upward.

In the embodiment of FIG. 7, since the drop prevention stepped portion 50B is formed in the element guide passage 51 slightly inside from the shoulder opening of the bottom slider 60, the insert pin 30 and the box pin 40 are to be hidden to the back side of the front blade 52 of the bottom slider 60. Accordingly, since the insert pin 30 and the box pin 40 can be hidden when the bottom slider 60 is located at the lower end, appearance of the slide fastener 10 with the separable bottom end stop can be finely finished.

Next, the state of inserting the second fastener stringer 16 to the top slider 50 and the bottom slider 60 from the separated state of the second fastener stringer 16 and the first fastener stringer 17 will be described with reference to FIGS. 8 and 9.

Figure 8:
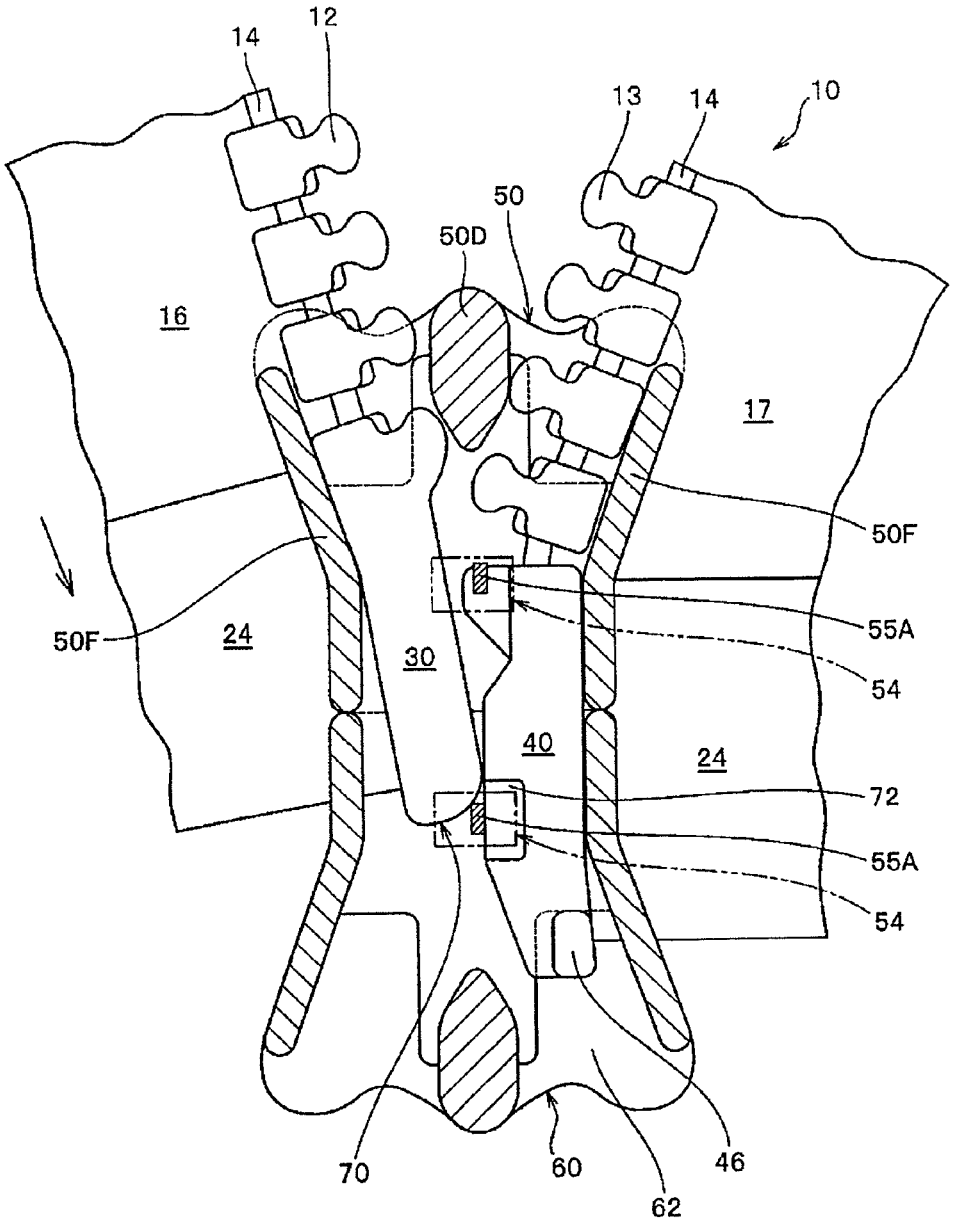
FIG. 8 is a sectional plane view illustrating a state where the insert pin of the second fastener stringer is inserted through a shoulder opening on the left side of the top slider and a retreat contact portion of a lower part of the insert pin is contacted with a stop pawl.
Figure 9:
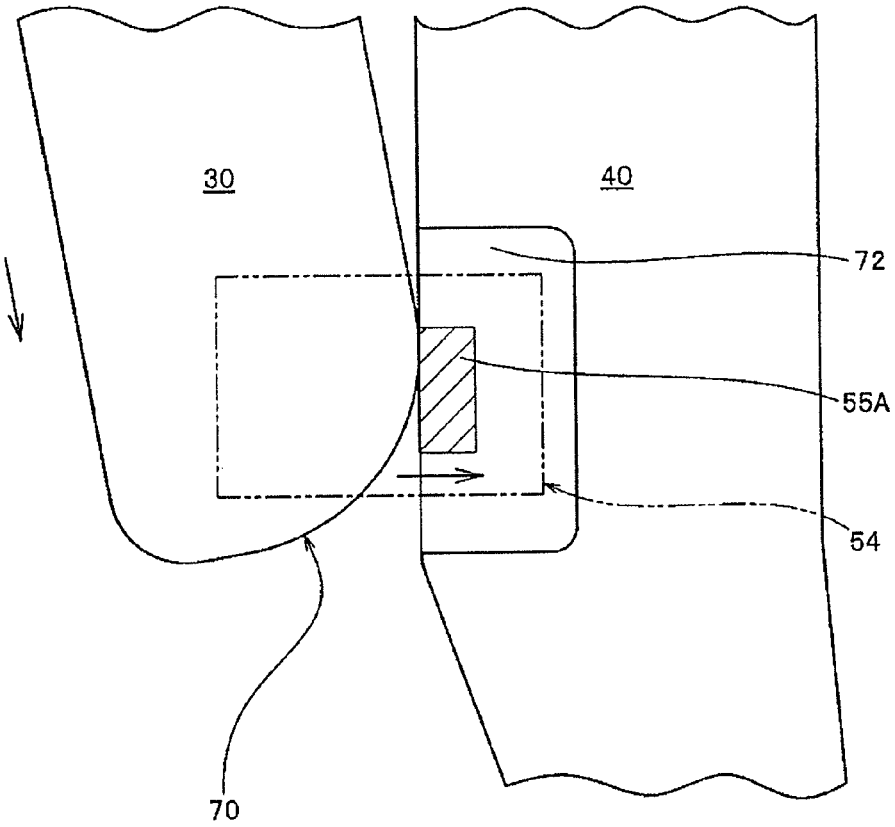
FIG. 9 is a sectional plane view illustrating by enlarging a part at which the retreat contact portion is contacted with the stop pawl in the state of FIG. 8.

FIG. 8 is a view illustrating an in-progress state of further inserting the insert pin 30 of the second fastener stringer 16 to the rear opening of the bottom slider 60 after inserting from the shoulder opening on the left side of the top slider 50. FIG. 9 is a partially enlarged view at the vicinity of the stop pawl 55A illustrating a state where the second fastener stringer 16 is inserted slightly deeper from the state of FIG. 8. Similarly to FIG. 7, FIGS. 8 and 9 are sectional plane views sectioned right below the front blade 52. Here, same numeral is given to the same member as that in FIG. 7 and the description will not be repeated.

When the second fastener stringer 16 is inserted to be in a state of FIG. 8, the retreat guide portion 70 formed at the corner portion of the insertion end of the insert pin 30 is contacted with the stop pawl 55A protruding into the element guide passage 51. The stop pawl 55A protruding into the element guide passage 51 is configured to be movable in the lateral direction to the insert pin 30 side and the box pin 40. Accordingly, when a user further inserts the second fastener stringer 16, the retreat guide portion 70 gradually retreats the stop pawl 55A as illustrated in the partially enlarged view of FIG. 9. Accordingly, the stop pawl 55A is stored in the pawl retreat portion 72 formed at the box pin 40 without being contacted with the box pin 40.

Thereafter, the insert pin 30 can be inserted to the position at which the second engaging portion 34 of the insert pin 30 is contacted with the first engaging portion 44 of the box pin 40 while having small resistance force of contacting between the insert pin 30 and the stop pawl 55A. When the top slider 50 is lifted upward in the state where the insert pin 30 is inserted to the lower end, the second element row 12 and the first element row 13 are coupled. In this manner, a left front body and a right front body of clothes are closed and both the front bodies can be coupled.

Second Embodiment

Next, an embodiment of applying the invention to a slide fastener with a separable bottom end stop capable of performing only upper opening will be described.

Figure 10:
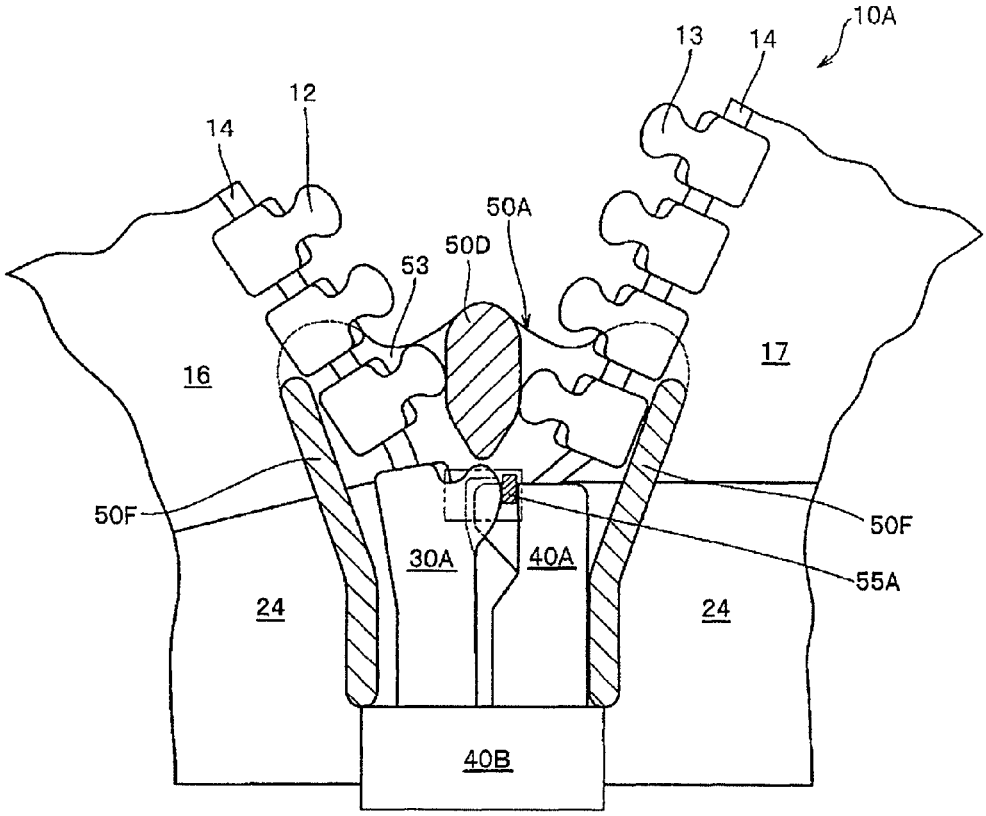
FIG. 10 is a sectional plane view illustrating an embodiment in which a slide fastener with a separable bottom end stop according to the invention is applied to an upper opening slide fastener.

FIG. 10 being a sectional plane view of a slide fastener 10A with a separable bottom end stop capable of performing only upper opening illustrates a state where a top slider 50A is lowered to the lowermost position. Similarly to FIG. 7 as described above, the sectional face of the sectional view of FIG. 10 illustrates a state of being sectioned right below the front blade of the top slider 50A.

Figure 11:
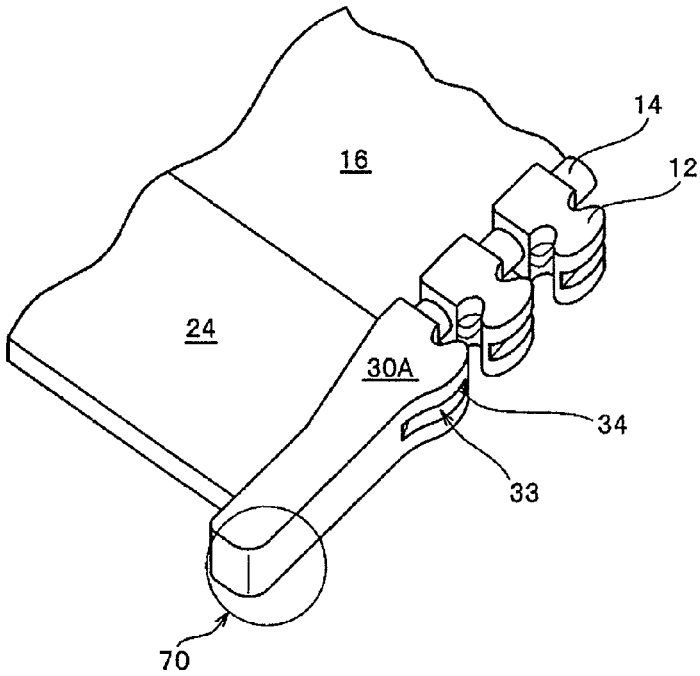
FIG. 11 is a partial perspective view of a lower end of a second fastener stringer to which an insert pin is continuously arranged in the upper opening slide fastener illustrated in FIG. 10.
Figure 12:
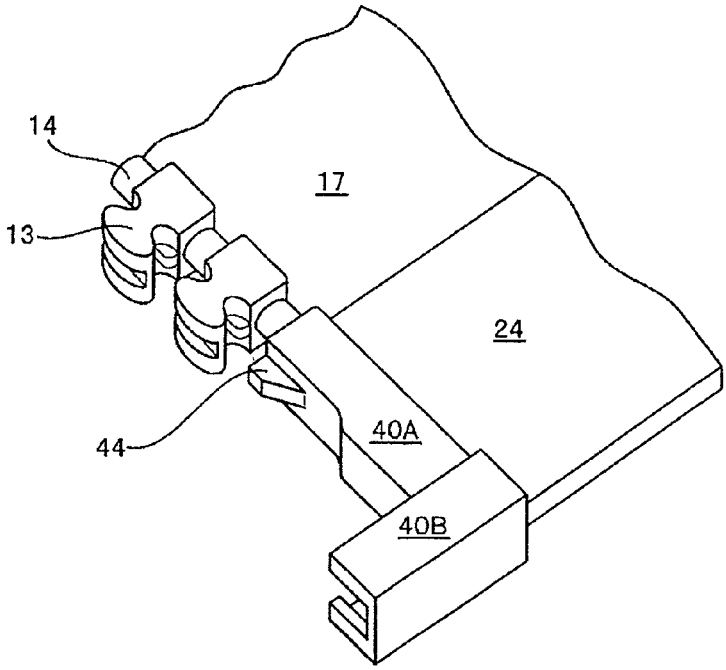
FIG. 12 is a partial perspective view of a lower end of a first fastener stringer to which a box pin is continuously arranged in the upper opening slide fastener illustrated in FIG. 10.

FIG. 11 is a partial perspective view of a lower end of the second fastener string 16 of FIG. 10. FIG. 12 is a partial perspective view of a lower end of the first fastener stringer 17 of FIG. 10. Here, the same numeral is given to the same member as that in FIGS. 5 to 7 and the description will not be repeated.

As illustrated in FIG. 10, the slide fastener 10A with the separable bottom end stop capable of performing only upper opening is provided with the second fastener stringer 16; the first fastener stringer 17; the second element row 12, a continuously arranged insert pin 30A at the lower side, the first element row 13 and a continuously arranged box pin 40A at the lower side, both the rows respectively having a number of elements serially arranged at predetermined intervals nipping the right and left core threads 14; and the top slider 50A with an automatic stopper enabling to perform upper opening.

As illustrated in FIGS. 10 and 12, a box body 40B to couple the right and left second fastener stringer 16 and first fastener stringer 17 by allowing insertion of the lower end part of the insert pin 30A is disposed at the lower end part of the box pin 40A. The box body 40B includes a recess to which the lower end part of the insert pin 30A is inserted. A slider with the stop pawl 55A having the same configuration of the top slider 50 as described with reference to FIGS. 2 to 4 may be employed as the top slider 50A. Here, a separable bottom end stop is constituted with the box pin 40A, the insert pin 30A and the box body 40B.

The slide fastener 10A with the separable bottom end stop illustrated in FIGS. 10 to 12 employs the separable bottom end stop having the box body 40B at the lower end of the box pin 40A. However, alternatively, it is also possible to apply the invention to a slide fastener of a side open type without utilizing the box body 40B.

The element guide passage through which the second element row 12 and the first element row 13 vertically passes is formed within the top slider 50A as being surrounded by the flange portion 50F and the connecting post 50D. The element guide passage includes the shoulder opening formed at the front end side and the rear opening formed at the rear end side of the top slider 50A. The separated right and left elements are introduced to or ejected from the element guide passage through the shoulder opening and the coupled right and left elements are introduced to or ejected from the element guide passage through the rear opening.

When the top slider 50A is lifted along the second element row 12 and the first element row 13, the right and left second element row 12 and first element row 13 which are in a separated state are ejected from the rear opening of the top slider 50A in a coupled state. On the contrary, when the top slider 50A is lowered, the second element row 12 and the first element row 13 in the coupled state are introduced trough the rear opening of the top slider 50A, and then, the second element row 12 and the first element row 13 are ejected in the separated state through the bilateral shoulder opening.

The stop pawl capable of protruding and retreating as being urged with predetermined force so as to prevent natural lowering movement of the slider is protruded to the element guide passage of the top slider 50A. Similarly to the slider described with reference to FIGS. 2 to 4, the stop pawl of the top slider 50A is configured to be movable in the lateral direction toward the insert pin 30A side and the box pin 40A side while being capable of protruding and retreating within the element guide passage.

Not illustrated in FIG. 10, the tab for grasping when a user vertically moves the top slider 50A along the second element row 12 and the first element row 13 is attached to the front blade of the top slider 50A. The stop pawl which is located between the adjacent elements of the second element row 12 and the first element row 13 as being inserted to the element guide passage is lifted by operating the tab so as to release the engaged state between the stop pawl 55A and the element of the first element row 13. In this manner, vertical operation of the top slider 50A can be freely performed.

As illustrated in FIG. 11, the round-chamfered retreat guide portion 70 which gradually retreats the stop pawl 55A to the box pin 40A side is formed at a corner portion of the insertion end of the insert pin 30A on the box pin 40A side. The retreat guide portion 70 is formed to be a round-chamfered shape as being symmetrical at both front blade and the back blade 53. Accordingly, in the embodiment of FIGS. 10 to 12 as well, components of the separable bottom end stop constituted with the insert pin 30A, the box pin 40A and the top slider 50A can be used for both the left- and right-insertions without modification. Here, the shape of the retreat guide portion 70 is not limited to the curved round-chamfered shape. It is also possible to adopt a straight corner-chamfered shape.

In the state of FIG. 10, since the top slider 50A is lowered to the lowermost position, the second fastener stringer 16 and the first fastener stringer 17 can be separated as pulling out the insert pin 30A from the top slider 50A by grasping the right and left reinforcement films 24 respectively with bilateral fingers in the above state and lifting the second fastener stringer 16 being the insert pin 30A side upward.

When the second fastener stringer 16 which is once separated is inserted through the shoulder opening of the top slider 50A, the retreat guide portion 70 formed at the corner portion of the insertion end of the insert pin 30A is contacted with the stop pawl 55A protruding into the element guide passage. The stop pawl 55A protruding into the element guide passage is configured to be movable in the lateral direction to the insert pin 30A side and the box pin 40A side. Accordingly, when a user further inserts the second fastener stringer 16, the retreat guide portion 70 gradually retreats the stop pawl 55A to the box pin 40A side. When the second fastener stringer 16 is further inserted, the lower end part of the insert pin 30A enters into the recess of the box body 40B, so that positioning in the lateral direction is performed. The insert pin 30A can be inserted to the position at which the second engaging portion 34 of the insert pin 30A is contacted with the first engaging portion 44 of the box pin 40A. When the top slider 50A is lifted upward in the state where the insert pin 30A is inserted to the lower end, the second element row 12 and the first element row 13 are coupled. In this manner, a left front body and a right front body of clothes are closed and both the front bodies are coupled.

INDUSTRIAL APPLICABILITY

The slide fastener with the separable bottom end stop according to the invention can be applied to slide fasteners such as metal fasteners, coil fasteners and the like as well as resin fasteners which utilize injection-molded products for elements.

The invention claimed is:

1. A slide fastener with a separable bottom end stop comprising:

a box pin continuously arranged at a lower end of a first element row which is disposed at one side edge of a first fastener stringer;

an insert pin continuously arranged at a lower end of a second element row which is disposed at one side edge of a second fastener configured to be capable of being separated from the first fastener stringer; and a top slider for upper opening including an automatic stopper which includes a pawl member having a stop pawl capable of protruding from and retreating into a pawl hole in a front blade, where the pawl hole extends into an element guide passage formed between the front blade and a back blade, an urging member capable of resiliently urging the stop pawl in a direction of protruding into the element guide passage, and a tab capable of raising the stop pawl in a direction of withdrawing from the element guide passage by upwardly moving a tab pivot portion that is disposed between the front blade and the pawl member, wherein the pawl hole has a wide opening extending right and left from a center line of the top slider configured to allow either right or left movement of the stop pawl within the pawl hole in the width direction, wherein when the stop pawl protrudes into the element guide passage and the insert pin is inserted into the top slider a pawl contact surface of the insert pin moves the stop pawl within the pawl hole to a box pin side.

2. The slide fastener with the separable bottom end stop according to claim 1, wherein the pawl contact surface is disposed at a corner portion of an insertion end of the insertion pin on the box pin side.

3. The slide fastener with the separable bottom end stop according to claim 1, wherein the box pin includes a pawl retreat portion capable of accommodating the pawl member when the pawl member is moved toward the box pin side.

4. The slide fastener with the separable bottom end stop according to claim 1, wherein rear openings of the top slider for upper opening and a bottom slider for reverse opening having the automatic stopper are disposed so as to face each other, and a drop prevention portion to prevent the bottom slider from dropping is formed at the box pin.

* * * * *

UNITED STATES PATENT AND TRADEMARK OFFICE

CERTIFICATE OF CORRECTION

PATENT NO. : 8,959,727 B2
APPLICATION NO. : 13/124691
DATED : February 24, 2015
INVENTOR(S) : Keiichi Keyaki et al.

It is certified that error appears in the above-identified patent and that said Letters Patent is hereby corrected as shown below:

On the Title page, in item (56), in column 2, under "Foreign Patent Documents", line 2, delete "11-176615" and insert -- 11-178615 --, therefor.

In the Claims

In column 13, line 15, in claim 1, delete "stop" and insert -- stop, --, therefor.

In column 13, line 22, in claim 1, after "fastener" insert -- stringer --.

Signed and Sealed this
Sixteenth Day of June, 2015

Michelle K. Lee

Michelle K. Lee
*Director of the United States Patent and Trademark Office*